United States Patent [19]

Muse, Jr.

[11] Patent Number: 4,619,619

[45] Date of Patent: Oct. 28, 1986

[54] COMBINATION SURFBOARD-KNEEBOARD

[76] Inventor: Lauchlin M. Muse, Jr., P.O. Box 925, Dunn, N.C. 28334

[21] Appl. No.: 735,758

[22] Filed: May 20, 1985

Related U.S. Application Data

[63] Continuation of Ser. No. 499,360, May 31, 1983, abandoned.

[51] Int. Cl.[4] ..... A63C 5/02

[52] U.S. Cl. ..... 441/65; 441/74; 441/75; 441/79

[58] Field of Search ..... 441/65, 74, 75, 79; D21/228, 307

[56] References Cited

U.S. PATENT DOCUMENTS

| | | | |
|---|---|---|---|
| D. 265,116 | 6/1982 | Churchill | D21/228 |
| 4,028,761 | 6/1977 | Taylor | 441/65 |
| 4,041,562 | 8/1977 | Nealy | 441/75 |
| 4,129,911 | 12/1978 | McDonald et al. | 441/74 |
| 4,379,703 | 4/1983 | Mizell | 441/79 |

*Primary Examiner*—Trygve M. Blix
*Assistant Examiner*—Edwin L. Swinehart
*Attorney, Agent, or Firm*—Larry L. Coats

[57] ABSTRACT

The present invention entails a combination surfboard-kneeboard. The multi-purpose aquatic board of the present invention is provided with detachable fins, ankle strap, and knee strap in order that the same can be utilized for either surfing or kneeboarding. Further, the board is elongated and includes a lower base portion and a raised upper deck having a cavity formed therein. A resilient pad, such as a neoprene pad, is secured within said cavity to form a resilient upper deck about a substantial portion of the board.

1 Claim, 4 Drawing Figures

COMBINATION SURFBOARD-KNEEBOARD

This is a continuation of U.S. patent application, Ser. No. 499,360, filed May 31, 1983, now abandoned.

FIELD OF INVENTION

The present invention relates to a water sport board, and more particularly to a combination surfboard-kneeboard.

BACKGROUND OF THE INVENTION

The popularity of water sports continues to increase. Whether it be water skiing, kneeboarding, surfing, windsurfing, or any other board type water sport, people of all ages are getting involved and taking part. There are many factors that contribute to the popularity of water sports and particularly to board type water sports. First, water sports and particularly board type water sports are of the nature that lend themselves to participation in and enjoyment by the entire family. Next water sports entail exercise. In addition, water sports are exciting, and the feelings and sensations that one experiences in, for example surfing or slalom water skiing, is perhaps not matched in any other sport.

Individuals interested in one water sport are also prone to be interested in other types of water sports. For example, it is not uncommon for an avid water skier to also by a very good surfer. In fact the different feelings and sensations that can be experienced through the various board type water sports encourages individuals to participate in a range of board type water sports.

This being the case, it is fitting that attention be directed at providing various water sport board designs that might be multi-functional. Moreover, in many water sport boards it is found that they are relatively expensive, especially in cases such as surfboards where some designs require substantial handcrafting. Therefore, in considering multi-purpose water sport board designs, attention should also be directed at reducing their cost, especially through designs that would obviate the necessity for handcrafting.

SUMMARY AND OBJECTS OF THE PRESENT INVENTION

The present invention entails a combination surf board-kneeboard. As implied, the combination water sport board of the present invention can be utilized for either surfing or kneeboarding.

Structurally, the combination surfboard-kneeboard is designed to be machine made and would essentially include a polyethylene outer wall structure filled with polyurethane. With respect to the combination surfboard-kneeboard design, the same would be elongated and would include a raised upper deck extended about a substantial top area thereof. Provided about the upper deck is a nonwaxed neoprene surface.

To accommodate either surfing or kneeboarding, the combination surfboard-kneeboard of the present invention is provided with a set of detachable fins. Certain fins can be selected and used for either surfing or kneeboarding. In addition, there is provided a detachable ankle strap for use in surfing and a detachable knee strap for use when the combination surfboard-kneeboard is used for kneeboarding.

It is, therefore, an object of the present invention to provide a multi-purpose water sport board that can be used for either surfing or kneeboarding.

Another object of the present invention is to provide a multi-purpose surfboard-kneeboard that is designed to be machine produced and which does not require handcrafting, thereby effectively reducing the total cost of such and providing a relatively inexpensive multi-purpose water sport board.

Another object of the present invention resides in the provision of a multi-purpose water sport board that is provided with improved buoyancy and flotation capacity.

Still a further object of the present invention is to provide a water sport board of the character referred to above that when used as a surfboard is highly maneuverable and controllable.

Another object of the present invention resides in the provision of a multi-purpose surfboard-kneeboard that is provided with a unique side edge surrounding rail structure that contributes to the stability and maneuverability of the multi-purpose water sport board of the present invention.

It is also an object of the present invention to provide a combination surfboard-kneeboard of the character discussed hereinabove wherein the design of the multi-purpose water sport board is such that the same can be modified easily and conveniently to change its mode of operation from surfing to kneeboarding and vice versa.

Another object of the present invention resides in the provision of a combination surfboard-kneeboard that is simple to manufacture, relatively inexpensive, lightweight, durable, relatively maintenance free, and easy to handle.

A further object of the present invention resides in the provision of a combination surfboard-kneeboard of the character referred to above that includes a raised upper deck and wherein the effective volume of the combination surfboard-kneeboard is substantial, thereby effectively increasing the buoyancy or floating capacity of the multi-purpose water sport board.

Other objects and advantages of the present invention will become apparent from a study of the following description and the accompanying drawings which are merely illustrative of the present invention.

COMBINATION SURFBOARD-KNEEBOARD

With further reference to the drawings, the combination surfboard-kneeboard of the present invention is shown therein and indicated generally by the numeral 10.

First viewing combination surfboard-kneeboard 10 in its entirety, it is seen that the same is generally elongated and includes a front portion 10*a*, a rear portion 10*b* and a midsection 10*c*. Although the length and various dimensions of the combination surfboard-kneeboard of the present invention may vary, in a contemplated design, the combination surfboard-kneeboard would be approximately five feet six inches long and would have a width of approximately twenty-two inches at its widest point which would be about the midsection 10*c* of the combination surfboard-kneeboard.

Figure 2:
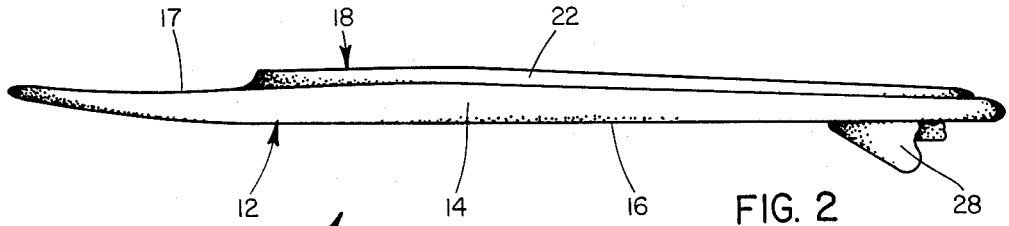
FIG. 2 is a side elevational view of the combination surfboard-kneeboard of the present invention.
Figure 3:
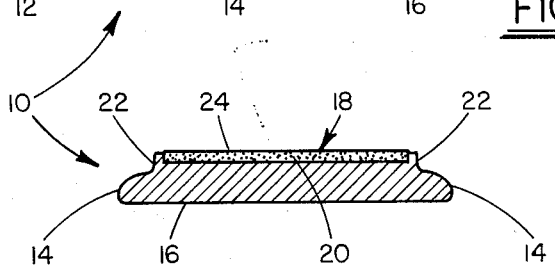
FIG. 3 is a cross-sectional view taken along lines 3—3 of FIG. 1.

As particularly illustrated in FIGS. 2 and 3, the combination surfboard-kneeboard 10 of the present invention includes a lower base portion, indicated generally by the numeral 12. Lower base portion 12 includes an outer rail structure 14 that extends around opposite side edge portions of the entire surfboard-kneeboard 10. In addition lower base portion 12 includes a generally flat bottom 16 and a top portion 17.

Figure 1:
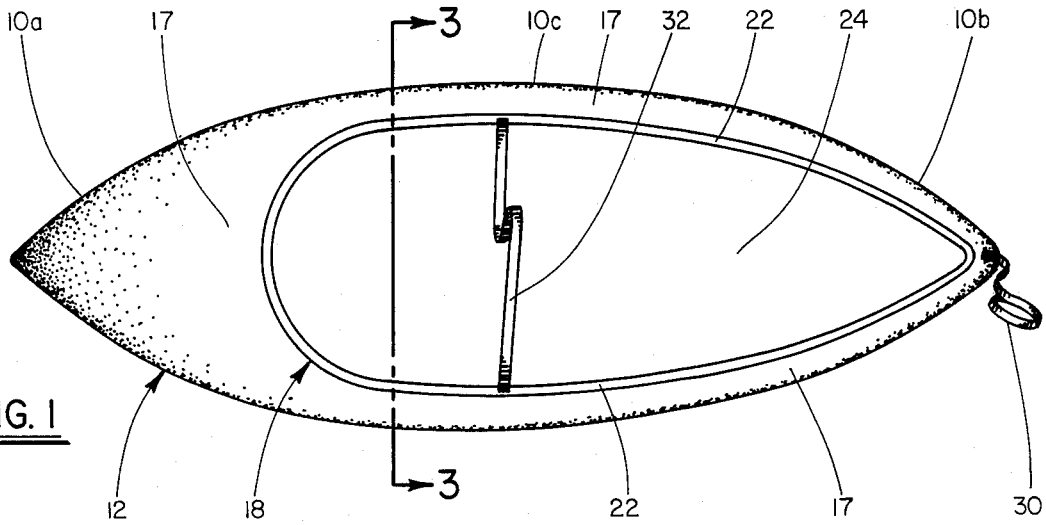
FIG. 1 is a top plan view of the combination surfboard-kneeboard of the present invention.

Formed over lower base portion 12 is the raised upper deck 18. Raised upper deck 18 includes a cavity 20 formed inwardly of an inner rail structure 22. As shown in FIG. 1, it is seen that the inner rail structure 22 is raised above the top surface 17 of lower base portion 12 and extends in an arcuate fashion about a front portion of the raised deck. In addition the raised inner rail structure 22 extend from front arcuate portion towards the sides of the surfboard-kneeboard 10 and from the midsection is directed rearwardly in a generally parallel fashion with respect to the outer rail 14 of lower base portion 12. This is best illustrated in FIG. 1. It should be pointed out that the height of the raised inner rail structure 22 may vary with respect to the top portion 17 of lower base 12 as the inner rail structure extends rearwardly. In addition, the angle that inner rail 22 forms with top 17 of lower base portion 12 may vary from front to rear of the combination surfboard-kneeboard 10.

Secured by glue or other suitable means within cavity 20 and disposed inwardly within the confines of raised inner rail structure 22 is a resilient pad 24 such as a neoprene pad. This forms a nonwaxed top surface for upper deck 18.

Therefore, it is appreciated that the provision of the raised upper deck yields an increased volume for a board of a given planar area. This increased volume should impart increase buoyancy and flotation capacity to the combination surfboard-kneeboard 10. In addition, the provision of the raised deck creattes a unique system of fluid flow dynamics for the combination surfboard-kneeboard 10 that contributes to improved handling and manuverability characteristics. In this regard, one is referring to the results (such as lift) that are achieved by particularly shaping the outer rail 14 and also the result that is achieved through the flow of water along and adjacent the raised inner rail 18 of the combination surfboard-kneeboard 10 when it is being used as a surfboard.

Figure 4:
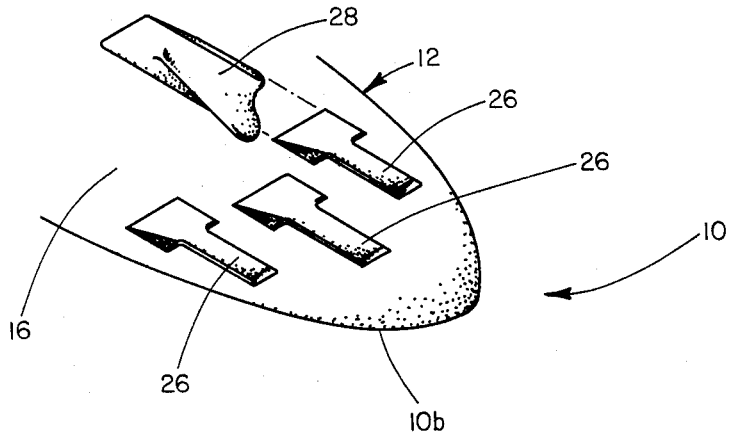
FIG. 4 is a fragmentary perspective view of the underside of the rear portion of the combination surfboard-kneeboard of the present invention, particularly illustrating a series of detachable fins.

Continuing to refer to the drawings, and particularly FIG. 4, it is shown that the combination surfboard-kneeboard 10 of the present invention has been provided with a plurality of removable fins. To accomplish this, about the bottom 16 of the lower base portion 12, there is provided three fin boxes 26. Each fin box is designed to received a detachable fin 28. Although the fin may be designed to be attached and detached several different ways, the present invention disclosure contemplates a "slide in" fin. In this case, each fin would include an upper base adapted to be received within two spaced apart rails. Some form of screw attachment can also be used in conjunction with the same to securely hold the respective fins 28 within the respective fin boxes 26.

For purposes of reference, the two fins disposed about the outer sides of the board 10 will be referred to as rail fins while the other fin will be referred to as a center fin.

In surfing, for example, one would ordinarily use a large fin disposed in the center. Two rail fins would be removed. In advanced surfing, however, one may choose to use two small rail fins.

In conventional kneeboarding, all fins could be removed. However, when standing on the board 10 and being towed by a boat, an individual might choose to use one short or small center fin. It is appreciated, that for water board sports for which the present board 10 may be used, that the respective fins 28 can be removed, added, or modified to suit a particular need and application.

To accommodate surfing, the combination surfboard-kneeboard 10 of the present invention is provided with a removable ankle strap 30. Preferably the ankle strap 30 would have a detachable elongated cord secured to the board itself, and further the same would be provided with padded nylon and a velcro attaching structure.

Further, for kneeboarding, the combination surfboard-kneeboard 10 of the present invention is provided with a detachable knee strap 32. Again the knee strap would be connected directly to kneeboard 10 but would be detachable therefrom when the same is being used as a surfboard. Also, the knee strap would preferably be of the padded nylon structure with velcro attaching structure incorporated therewith.

Although the combination surfboard-kneeboard 10 of the present invention may be constructed of various materials and in various ways, it is contemplated that the present multi-purpose water sport board would be machine produced with little or no handcrafting involving. To accomplish this, it is contemplated that the outer wall structure of the board 10 could be constructed by an injection molding process and the outer wall structure would essentially comprise polyethylene. Filled within the outer wall structure would be polyurethene.

From the foregoing specification and discussion, it is appreciated that the present invention presents a very unique combination surfboard-kneeboard 10. It follows that the same has substantial utility inasmuch as the same can be used for both surfing and kneeboarding. Of principal importance is the construction of the combination surfboard-kneeboard 10 with the raised upper deck structure 18. Such makes the board useful in both surfing and kneeboarding plus contributes to a new system of fluid dynamics that enables the combination board 10 to be highly manuverable, stable and very controllable.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claim are intended to be embraced therein.

I claim:

1. A combination surfboard-kneeboard comprising: an elongated buoyant board having front and rear end portions with said front end portion including a turned up nose, and a midarea located generally halfway between said front and rear end portions, said board being wider about the midarea than at said front and rear end portions and wherein the widest portion of said board is located between said midarea and said rear end portion; said board further including a lower base portion and a generally flat bottom with said lower base portion having an outer surrounding turned down rail structure and a raised upper deck formed over said lower base portion and extending from said midarea to said rear end portion; said raised deck having forward and side portions and including an inner rail structure indented from said outer turned down rail structure of said lower base portion and which extends around said forward and said side portions of said upper raised deck; said indented inner rail structure of said upper deck forming an angle with respect to said turned down rail of said lower base portion and wherein said angle of said inner rail with respect to said turned down rail of said lower base portion varies from said midarea to said rear end portion, said raised upper deck including a formed cavity that lies inwardly from said raised inner rail structure with said cavity including a flat bottom that lies below the top of said inner rail structure; a resilient pad secured within said cavity formed in said upper deck; a plurality of detachable fins adapted to be detachably secured to the underside of the lower base portion of said board; a detachable knee strap detachably secured to said board and adapted to extend over the midarea thereof and operative to confine an individual's knees about said board when said board is being used as a kneeboard; and a detachable ankle strap detachably secured to said board for use when the same is being used as a surfboard.

* * * * *